United States Patent [19]

Grossniklaus

[11] 4,181,082

[45] Jan. 1, 1980

[54] SOLID FUEL FURNACE

[76] Inventor: Hans Grossniklaus, Garage, 3855 Brienz, Switzerland

[21] Appl. No.: 915,168

[22] Filed: Jun. 14, 1978

[30] Foreign Application Priority Data

Jun. 17, 1977 [CH] Switzerland ..... 7454/77

[51] Int. Cl.[2] ..... F23L 1/02; F23K 5/00

[52] U.S. Cl. ..... 110/297; 110/293; 110/109

[58] Field of Search ..... 110/109, 293, 297

[56] References Cited

U.S. PATENT DOCUMENTS

| | | | |
|---|---|---|---|
| 2,454,400 | 11/1948 | Norman | 110/293 |
| 2,694,990 | 11/1954 | Klijzing et al. | 110/293 |
| 3,863,779 | 2/1975 | Stockman | 110/109 |

*Primary Examiner*—Kenneth W. Sprague

*Attorney, Agent, or Firm*—Brady, O'Boyle & Gates

[57] ABSTRACT

An elongate combustion chamber is inclined at a 50° to 80° angle to the vertical, is connected at the lower end face to a feed duct through which fuel is pushed into the chamber and is open at the upper end face. The side walls forming the lower part of the chamber are downwardly converging and the free edges are spaced from each other at a distance decreasing in the direction of the open upper end face from the lower end face to form a primary air opening from a primary air channel therebeneath, the tapered opening covered by corresponding downwardly converging solid side walls connected at an apex and spaced from the other walls to form an air passage therebetween from the primary air channel to the combustion chamber. The upper side walls of the combustion chamber defining the lower partition of a secondary air channel and being provided with openings for secondary air feed into the chamber, end plates sealing the upper and lower ends of the chamber and primary and secondary air channels, and blast-air feed conduits connected into the lower ends of the primary and secondary air channels to supply air thereto from a blower.

8 Claims, 2 Drawing Figures

Fig. 1
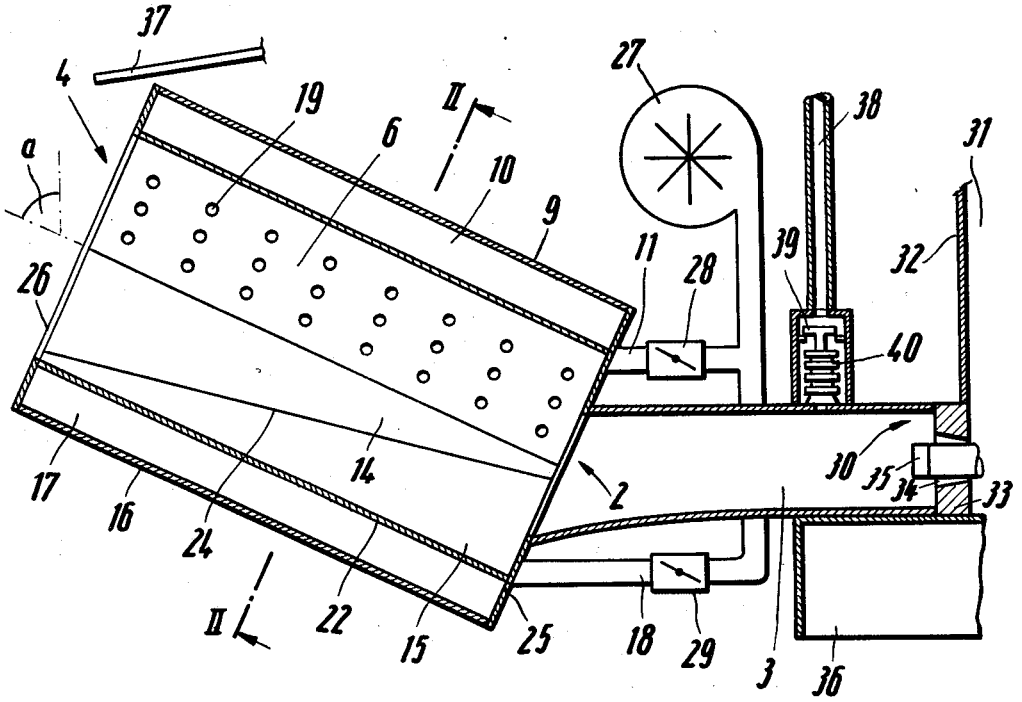
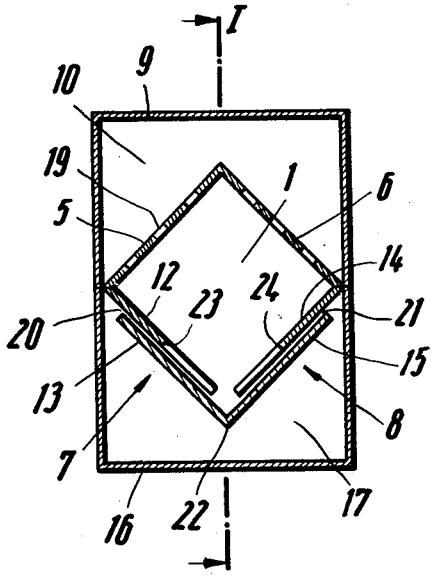
Fig. 2

SOLID FUEL FURNACE

BACKGROUND OF THE INVENTION

Field of the Invention

This invention relates to a furnace installation for burning solid fuel, such as wood.

The purpose of the invention is to provide a structure that produces the combustion of solid fuel and of the gases which arise as a result of decomposition by heat of the solid fuel, as complete and as smokeless as possible.

SUMMARY OF THE INVENTION

In accordance with the invention, this is achieved by a furnace structure that comprises a combustion chamber which is elongate, is inclined at an angle to the vertical, is connected at one end face thereof to a feed duct for the fuel and is open at the other end face thereof, the lower part of side-walls surrounding the combustion chamber between the end faces forming a channel having a downwardly-tapered cross-section, and defining the upper part of a primary air chamber and being provided with openings for primary air, which openings are arranged at a spacing, decreasing in the direction of the open end face of the combustion chamber, from the underside of the combustion chamber, the upper part of the side-walls of the combustion chamber defining the lower part of a secondary air chamber and being provided with openings for secondary air, and a respective blast-air feed pipe is connected to supply air into the primary air chamber and into the secondary air chamber.

The primary air is, of course, the air for combustion, flowing into or onto the solid fuel, and the secondary air is the air for combustion of gases which arise from heat-decomposition of the solid fuel, which flows into the flames above the fuel.

Preferably the combustion chamber is inclined at an angle to the vertical substantially in the range from 50° to 80°, the open end face positioned at the upper or higher end of the combustion chamber and the end face connected to the feed duct lying at the lower end of the combustion chamber. The angle of inclination to the vertical, in this angular range, on the one hand is so great that combustion residues (such as ash and slag) are pushed upward in the combustion chamber by the solid fuel pushed through the feed duct into the lower end of the combustion chamber, and can drop out of the combustion chamber at the open end face, and on the other hand is so small that the fuel pushed into the combustion chamber cannot roll out or slip out of the combustion chamber prior to complete combustion at the open end face.

Advantageously the lower part of the combustion chamber is bounded by two downwardly-converging side-walls which form a wedge-shaped channel and each of which comprises two parallel plates which overlap one another in such a way as to define, in the overlap region, a gap which forms the openings for the primary air and through which the primary air flows out of the primary air chamber and into the combustion chamber in the direction of the wedge apex edge of the channel. Since the two gaps which form the openings for the primary air are directed upwards from the combustion chamber, neither portions of fuel nor combustion residues can fall through them into the primary air chamber, which would be possible in the case of side-walls which each consist of a single plate and were provided with openings. The spacing of the two gap openings, opening into the combustion chamber, from the underside of the combustion chamber advantageously decreases in the direction of the open end of the combustion chamber. This ensures that the primary air completely penetrates the entire fuel, the upper region of the fuel being penetrated by the primary air at that end face of the combustion chamber which is connected to the feed duct and the central and lower regions of the fuel being penetrated by primary air gradually in the direction of the open end face, which leads to complete combustion of the fuel.

BRIEF DESCRIPTION OF THE DRAWINGS

The invention will be described further, by way of example, with reference to the accompanying drawings, in which:

FIG. 1 is a longitudinal section through a preferred embodiment of the furnace installation of the invention; and FIG. 2 is a cross-section view through the combustion chamber of the installation, the section being taken along the line II—II of FIG. 1.

Referring to the drawings in greater detail they illustrate an elongate combustion chamber 1 which is inclined at an angle a which is approximately 65° to the vertical. The combustion chamber 1 is connected, at the one end face 2, to a feed duct 3, which widens in the direction of the combustion chamber 1, for the fuel, and which is open at the other end face 4. The combustion chamber 1 is surrounded by four side-walls 5, 6, 7 & 8 (FIG. 2), and in cross-section has the shape of a square standing on one corner. The two upper side-walls 5 and 6 are formed by an angle iron. Arranged above the angle iron 5, 6 is an inverted U-iron or channel member, the free limb ends of which are welded to the free limb ends of the angle iron 5,6. The angle iron 5,6 and the U-iron 9 define a secondary air chamber 10 into which a blast-air feed pipe 11 opens at the end face which is to the right in FIG. 1.

Each of the two lower side-walls 7 and 8 consists of two spaced, parallel, overlapping plates 12, 13 and 14,15, respectively, the lower plates 13 and 15 forming the limbs of an upwardly opening angle iron. Arranged under the side-walls 7 and 8 is a U-iron or channel member 16 the free limb ends of which are welded to the upper edges of the plates 12 and 14, and to the free ends of the limbs or side webs of the U-iron 9. The side-walls 7,8 and the U-iron 16 surround a primary air chamber 17 into which a blast-air feed pipe 18 opens at the end face which is to the right in FIG. 1. The side-walls 5,6 have holes 19 therethrough, directed toward the axis of the combustion chamber 1, for the secondary air in secondary air chamber 10. The spaced plates 12,13 and 14,15 define, in the overlap region, respective gaps 20 and 21 (FIG. 2), through which the primary air flows out of the primary air chamber 17, between the plates 12,13 and 14,15, and into the combustion chamber 1, namely in the direction of the apex edge 22 of the angle iron 13,15. The lower free edges 23 and 24 of the plates 12 and 14 are spaced apart and extend obliquely, at a distance from the apex edge 22 which decreases from the end face 2 to the end face 4.

At the end faces 2,4 a respective rectangular plate 25,26, which is adapted to the two U-irons 9,16, is welded to the U-irons 9,16, the side-walls 5,6 and the plates 12, 13, 14, 15, the plate 25 having openings for connection thereto of the feed duct 3 and the blast-air feed pipes 11,18, and the plate 26 having a square opening corresponding to the cross-section of the open upper end of the combustion chamber. The two blast-air feed pipes 11,18 are connected to a common blower 27 and are provided with respective throttle valves 28,29 for regulating the supply of air from the blower into the air chambers 10 and 17.

A charging device 30 is arranged at the end of the feed duct 3 which is remote from the combustion chamber 1. The charging device 30, which is not shown in detail in the drawings, may be of the type as disclosed in my copending application Ser. No. 893,256, filed Apr. 5, 1978, the disclosure of which is incorporated herein by reference and briefly comprises a container 31, the front wall 32 of which has an opening into which is secured an annular matrix 33 having a conical opening 34 therethrough which opens into the feed duct 3. A ram 35 which is in alignment with the feed duct 3 and which is reciprocated in the container 31 containing fuel such as wood, by means of a drive device, extends at the end of the working stroke into the opening 34, as shown. During the working stroke the ram 35 pushes fuel through the aperture into the feed duct 3, and pieces of fuel too large to fit through the aperture are pushed against the die 33 and are splintered and broken by the advancing ram 35 which pushes the broken pieces through the aperture 34. The charging device 30 and the feed duct 3 are carried by a mounting pedestal 36. A regulating device (not shown) which determines the combustion temperature in the combustion chamber 1 by means of a thermocouple element 37 arranged at the open end face 4 of the combustion chamber 1, regulates the feed performance of the charging device 30 in such a way that the combustion temperature is constant.

To quench a fire arising in the feed duct 3, connected to an opening at the upper side of the feed duct 3 is a water pipe 38 which is shut off at the connection point by a valve 39 which is actuatable by means of a thermostat. The thermostat consists of a closed corrugated-tube springbody or bellows 40 in which is located an easily boiling liquid, e.g. methanol, which evaporates with increase in temperature and in so doing expands the spring body or bellows 40. In this way the valve 39 is opened and water flows out of the water pipe 38 into the feed duct 3, the spring body 40, around which the water flows, contracts and after a certain time closes the valves 39 once more.

Arranged at the end face 4 is an ignition device (not shown), for example an oil burner, glow wire or gas burner, which is directed into the combustion chamber 1 and which is controlled by a control device, having a photodetector or a temperature sensor, in such a way that, upon the cessation of the photodetector or temperature sensor signal indicating the burning or glowing of the fuel in the combustion chamber 1, it ignites and remains switched on for a predetermined period of time.

Arranged under the end face 4 of the combustion chamber 1 is a slag bucket (not shown) for slag or ash which is ejected from the combustion chamber 1 by the advanced fuel. The slag can be conducted to the slag bucket through a slag runoff which is fastened to the plate 26 and which connects to the underside of the angle iron 13,15, or through a slag channel formed on the plate 26 and the U-iron 16.

The mode of operation of the furnace installation is as follows. The installation can be used, for example, to produce the heat for a central heating system, the combustion chamber 1 being arranged under a boiler of the central heating system. When the furnace installation is switched on, which can be effected by the thermostat of the boiler of the central heating system, the charging device 30 and the blower 27, and (if the photodetector or the temperature sensor is not emitting a signal which indicates the burning or glowing of the fuel in the combustion chamber 1) the ignition device, are brought into service. Upon its working stroke, the reciprocated ram 35 pushes fuel out of the container 31, through the aperture 34 of the die and into the feed duct 3, whereby the fuel already present in the feed duct 3 and in the combustion chamber 1 is advanced. The blower air, regulatable by means of the throttle valve 29 and flowing into the primary air chamber 17, is heated on the walls 7,8 and passes through the gaps 20,21 into the combustion chamber 1. In doing so, the primary air penetrates an upper region of the fuel at the end face 2 and gradually deeper regions of the fuel in the direction of the end face 4 which ensures complete combustion of the fuel. The blower air, regulatable by means of the throttle valve 28 and flowing into the secondary air chamber 10, is heated on the walls 5,6 and passes through the holes 19 into the combustion chamber 1. Since the walls 5,6 define the upper part of the combustion chamber 1, they, and therewith the secondary air flowing into the combustion chamber 1, are greatly heated. In this way the result is achieved that the temperature of the secondary air lies above the ignition temperature of the gases which arise upon the heat decomposition of the fuel. Because of the mutually-oblique, upwardly-converging arrangement of the side-walls 5,6, the result is achieved that the secondary air stream emerging through the holes of the side-wall 5 crosses the secondary air stream emerging through the holes of the side-wall 6, so that turbulence and, therewith, optimum intimate mixture of the hot secondary air with the gases to be combusted is effected, which ensures the complete combustion thereof.

If the thermocouple element 37 indicates that the desired combustion temperature is exceeded, then the charging device 30 is switched off by the regulating device and switched on again only upon reduction in temperature to below the desired combustion temperature. As a result, a constant combustion heat flow is made possible even when using fuels having different heating values, such as sawdust, paper, pieces of wood, coal and so forth.

In another embodiment of the invention, the regulating device which has the thermocouple element 37 can be switched over, by a switch which is actuatable manually or by means of a thermostat of a heating installation, from a first position into a second position. In the closed position of the switch, the charging device 30 and the blower 27 are switched on and the regulating device is in the first position. In the open position of the switch, the charging device 30 and the blower 27 are switched off and the regulating device is in the second position.

In the first position, the regulating device regulates the feed performance of the charging device 30 in such a way that the combustion temperature in the combustion chamber 1 does not exceed an upper desired temperature, by switching the charging device 30 off for a short time when the desired (or rated) temperature is exceeded. In the second position, the regulating device switches the charging device 30 and the blower 27 on once more if the temperature in the combustion chamber 1 falls below a lower desired value. After a predetermined period of time or a predetermined temperature rise, the regulating device switches off the charging device 30 and the blower 27 once again. The lower desired temperature and the predetermined period of time or the predetermined temperature rise respectively are, then, so selected that an extinguishing of the fire or of the glow in the combustion chamber 1 is prevented. In this embodiment, the ignition device controlled by the control device can be omitted, since, when the installation is started up, the fuel can, for example, be ignited by hand and after that extinguishing of the fire is prevented by the regulating device.

Instead of the thermocouple element 37, a photodetector, for example a photoresistor, measuring the intrared radiation which occurs upon the combustion may be used.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

What I claim is:

1. In a furnace installation for burning solid fuel a combustion chamber which is elongated and is inclined at an angle to the vertical, a feed duct through which solid fuel is adapted to be conveyed, said combustion chamber having one end face connected to said feed duct and having an opposite open end face, a primary air chamber connected beneath and a secondary air chamber connected above said combustion chamber, lower side-walls defining the lower part of the combustion chamber between the end faces forming a channel having a downwardly-tapered cross-section and defining the upper part of said primary air chamber, said lower side-walls being provided with openings for primary air from the underside of the combustion chamber, said primary air openings having a lateral dimension decreasing in the direction of the open end face of the combustion chamber, upper side-walls defining the upper part of the combustion chamber and defining the lower part of the secondary air chamber and being provided with second openings therethrough for secondary air, a source of air, and blast-air feed conduits connected from said source of air to the primary air chamber and the secondary air chamber.

2. An installation as set forth in claim 1, in which the combustion chamber is inclined at an angle to the vertical substantially in the range of 50° to 80°, the open end face positioned at the higher end of the combustion chamber and the said one end face connected to the feed duct positioned at the lower end of the combustion chamber.

3. An installation as set forth in claim 1 or 2, in which the lower part of the combustion chamber is bounded by two downwardly-converging side-walls which form a wedge-shaped channel.

4. An installation as set forth in claim 3, in which each of the two side-walls forming the wedge-shaped channel comprises two spaced parallel plates which overlap one another in such a way as to define, in the overlap region, a gap which forms the openings for the primary air and through which the primary air is adapted to flow out of the primary air chamber and into the combustion chamber in the direction of the wedge apex edge of the channel.

5. An installation as set forth in claim 1, in which the upper side-walls defining the upper part of the combustion chamber comprise two upwardly-converging side-walls connected at their upper edges and which have said second openings for the secondary air.

6. An installation as set forth in claim 1, in which two blast-air feed conduits are connected to said source of air which comprises a common blower, and respective members for regulating the feed of blower air connected in said two feed conduits.

7. An installation as set forth in claim 1, including for an extinguishing agent connected to the feed duct, a thermostat in communication with said feed duct, and a shut-off member connected in said pipeline and connected for control by said thermostat, which in the event of temperature elevation by burning of fuel present in the feed duct functions to open the shut-off member and, after cooling by the extinguishing agent, functions to close the shut-off member.

8. An installation as set forth in any of claims 1, 2 or 7, including a charging device connected to that end of the feed duct which is remote from the combustion chamber, at least one blower connected to the blast-air feed conduits, a switch actuatable manually or by a thermostat of a heating installation for switching said charging device and said blower on and off, and a regulating device with a temperature sensor or a photodetector connected to sense the temperature or radiation in the region of the combustion chamber and, when the charging device is switched on and the blower is switched on, is operative to regulate the feed performance of the charging device in such a way that the temperature or radiation does not exceed a desired upper limit and, with the charging device switched off and the blower switched off, is operative to switch these on again if the temperature or radiation drops below a lower desired value and after that switches same off once more in a time-dependent or temperature-dependent manner, in order to prevent extinguishing of the fire or of the glow in the combustion chamber.

* * * * *